US005581918A

United States Patent [19]

Schilling et al.

[11] Patent Number: 5,581,918

[45] Date of Patent: Dec. 10, 1996

[54] APPARATUS FOR STRETCHING OUT A CLOTH PORTION

[75] Inventors: Christian Schilling, Winterthur; Max Tanner, Thal, both of Switzerland

[73] Assignee: Sefar AG, Thal, Switzerland

[21] Appl. No.: 328,813

[22] Filed: Oct. 25, 1994

[30] Foreign Application Priority Data

Oct. 27, 1993 [DE] Germany ..... 43 36 732.1

[51] Int. Cl.[6] ..... D06C 3/08; B41F 15/36

[52] U.S. Cl. ..... 38/102.1; 38/102.91; 101/127.1

[58] Field of Search ..... 38/102, 102.1, 38/102.91; 101/127.1; 160/371, 378, 382, 399, 432

[56] References Cited

U.S. PATENT DOCUMENTS

| | | | |
|---|---|---|---|
| 3,315,301 | 4/1967 | Dibblee et al. | 38/102.91 X |
| 4,382,343 | 5/1983 | Chahanian | 38/102.91 |
| 4,442,772 | 4/1984 | Bubley | 101/127.1 |
| 4,978,414 | 12/1990 | Ohtani et al. | 101/127.1 X |
| 5,235,908 | 8/1993 | Froelicher et al. | 101/127.1 |

*Primary Examiner*—Ismael Izaguirre
*Attorney, Agent, or Firm*—Bachman & LaPointe, P.C.

[57] ABSTRACT

In an apparatus for stretching out a rectangular gauze material or the like cloth portion in a printing frame with tensioning devices which are arranged at the sides thereof and in which the cloth portion is fixed by a respective clamping mouth comprising clamping jaws (32, 36) which are movable relative to each other and which can be applied against each other on the closing travel of a closing lever under a pressing pressure and then the cloth portion is tensioned by a change in position of the clamping mouth units, caused by a piston/cylinder unit for a flow medium, in the pulling direction, when the clamping jaws (32, 36) are brought together the closing travel which is determined by the closing lever (50) is followed by a further closing travel and same is controlled by a piston rod. In addition the piston rod is to be part of the piston/cylinder unit for the pulling movement of the stretching device (16). Associated with the piston in the cylinder (20) are an open position of the clamping mouth (18), which is near the clamping jaws (32, 36), a central position with closed clamping jaws, and an adjoining stroke path for the stretching operation.

12 Claims, 8 Drawing Sheets

APPARATUS FOR STRETCHING OUT A CLOTH PORTION

BACKGROUND OF THE INVENTION

The invention concerns an apparatus for stretching out a cloth portion, in particular a rectangular gauze material, on a printing frame with stretching devices which are arranged at the sides of the frame and in which the cloth portion is fixed by means of a respective clamping mouth comprising clamping jaws which are movable relative to each other and which can be applied to each other on the closing travel of a closing lever under a pressing pressure, and the cloth portion is then tensioned by a change in position of the clamping mouth units, caused by a piston/cylinder unit for a flow medium, in the pulling direction.

An apparatus of that kind is described in Swiss patent specification No. 679 918, with the indication that the production of printed circuit boards by a screen printing procedure involves a very high level of accuracy in respect of the cloth portion which is used in a screen printing stencil, and for that reason extremely uniform stretching of the cloth portion is required; irregularities in the distribution of tension give rise to distortion phenomena in the cloth portion and stress and tension peaks which can occur therein can result in undesired tearing. According to Swiss patent specification No. 679 918 those disadvantages are said to be possible by virtue of a clamping mouth which is closable by means of a mechanical lever system, the clamping mouth comprising a pair of clamping jaws connected to the free end of a piston rod of the piston/cylinder unit by a universal joint. The fact that an upper clamping jaw is mechanically pressed by a closing lever on to a lower clamping jaw which is fixed in the pressing direction means that they cannot be individually acted upon by a quantifiable pressing force, in other words, it is not possible to provide for adaption thereof to the respective factors involved, when the cloth portion is clamped in place.

SUMMARY OF THE INVENTION

In consideration of that state of the art, the inventor set himself the aim of improving the apparatus of the kind set forth in the opening part of this specification, while avoiding the recognised deficiencies, and making it possible to control adaptation of the pressing force to the clamping jaws during the stretching operation.

That object is attained by the teaching set forth in the independent claim; the appendant claims set forth particularly desirable developments.

In accordance with the invention, when the clamping jaws are brought together, the closing travel which is determined by the closing lever is followed by a further closing travel, under the control of the piston rod of the cylinder piston, in such a way that associated with the piston in the cylinder are an open position in respect of the clamping mouth, which is near the clamping jaws, a central position with closed clamping jaws after a partial stroke length, and a stroke path for the stretching operation. A piston disk is preferably associated with the piston rod.

In accordance with a further feature of the invention there is provided a short-stroke cylinder by which the respective clamping mouth is disposed prior to insertion of the cloth portion beneath the surface of the advanced printing frame and can be closed after the insertion operation, whereafter the short-stroke cylinder can be actuated for unlocking a slider or carriage and the clamping mouth can be set above the surface. In addition until disengagement of a retaining member for the short-stroke cylinder the clamping mouth is to be held in that gripping position, in which respect a piston disk can be moved into the central position over the partial stroke length.

The cylinder which is held towards its end by a pivotal mounting on the base or support profile member is displaceably supported at the other end at a tubular connecting portion to which the piston rod is fixed with its end remote from the piston. The piston rod also passes through an end plate of the cylinder, the piston rod resting movably in the sealed through bore thereof.

It has been found desirable for the tubular connecting portion to be pivotally connected to a guide element and for the latter to be pivotally connected to a slider or carriage which carries the clamping jaws; the slider or carriage is to be supported on a profile member which is in the form of a base element.

The guide element is advantageously a loop-shaped member whose limbs engage over the two side surfaces of the profile member and are connected to the slider or carriage by a rotary axis. Parallel to the latter the slider or carriage carries a pivot axis for a hood-like support member of the movable clamping jaw.

It is also in accordance with the invention that the hood-like support member, in the form of a pivotable body with parallel side walls—flanking the tubular connecting portion—adjoins the pivot axis of the slider or carriage and holds the clamping jaw from above, with a front edge which is parallel to the pivot axis. In addition the arrangement is to be such that disposed opposite the pivot location for the tubular connecting portion on the other side of the rotary axis on the limb of the loop-shaped member is a pivot point for a control bar which at the other end is pivotally connected to the pivotable body thereof.

In accordance with a further feature of the invention a pivot pin is connected, as a pivot between the control bar and the pivotable body—by way of a pin member which is rotatably mounted in the latter—to a rocker member whose other end provides a slot for a pivot axis of the loop-shaped member.

In accordance with the invention the pivot axis for the rocker member is guided by the limb of the loop-shaped member about the pivot point thereof for the control bar.

The particular association of the loop-shaped member and the pivotable body which is fitted channel-like over same, with the slider or carriage, produces, with the axes and pivotal connecting points thereof, for the elongate connecting members which connect them—control bar and rocker member—a relative movement of the clamping jaws, which movement can be controlled accurately by mechanical means and flow agent.

It has been found particularly desirable for the profile member which guides the slider or carriage to be adapted to be raised by a stroke cylinder which is mounted adjacent the printing frame beneath the profile member. In addition a retaining member is to be disposed in the vicinity of the stroke cylinder, the retaining member engaging into the slider or carriage to hold same in the forward limit position thereof. In accordance with the invention the clamping mouth can also be disposed above a plane defined by the frame in a limit position of the slider or carriage.

Further advantages, features and details of the invention will be apparent from the following description of preferred embodiments and with reference to the drawing in which:

DETAILED DESCRIPTION OF THE PREFERRED EMBODIMENTS

Figure 3:
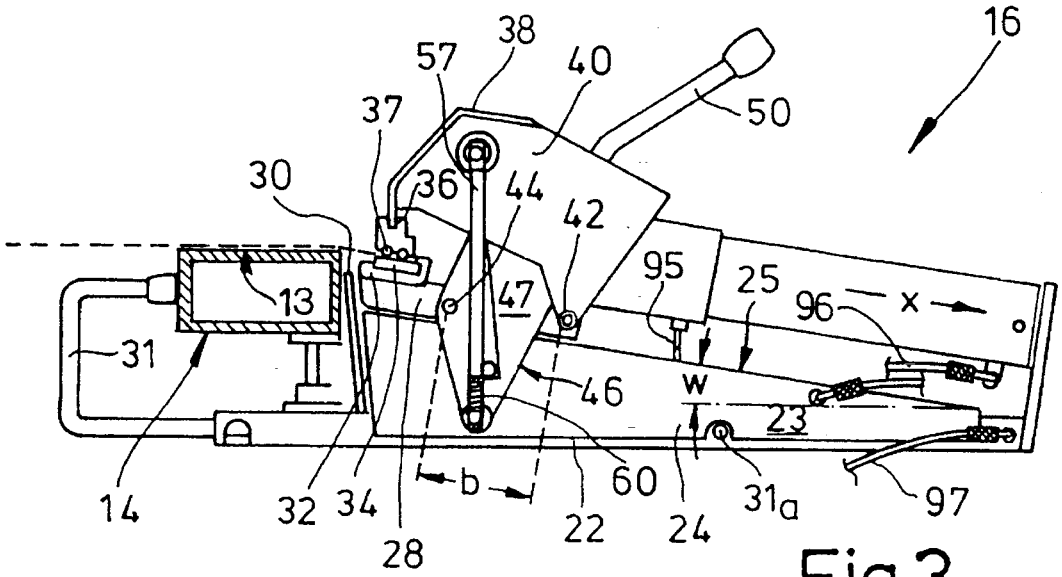
FIG. 3 is a side view of the structure shown in FIG. 2.
Figure 2:
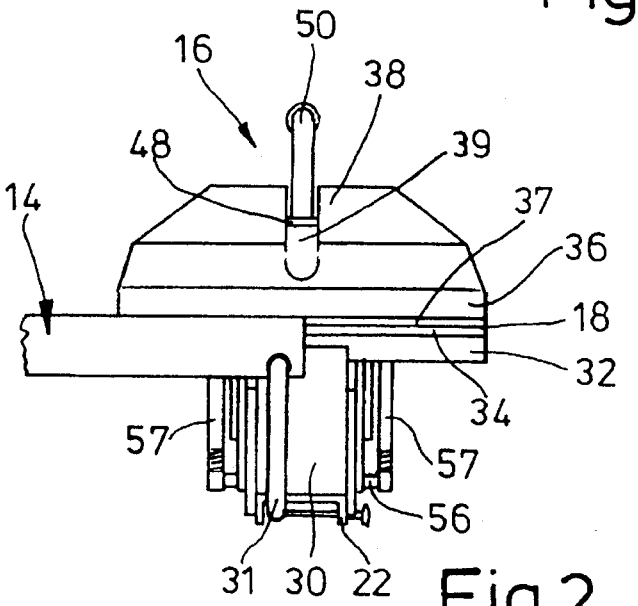
FIG. 2 is a front view of a stretching device, on a larger scale than FIG. 1.

An apparatus 10 for stretching a rectangular portion of cloth or fabric or a web 12 of preferably gauze-like screen material for use in a screen printing process has—along the four sides of a frame 14—a plurality of clamping elements or stretching devices 16. They engage with a respective clamping mouth 18 (see FIGS. 2 and 3) a portion of the web 12 in the edge region thereof and stretch the web 12 which is then fixed all around, by displacement of a respective pulling cylinder 20 in the pulling direction x. In FIG. 3 the web 12 lies on the surface 13 of the frame 14 and is pulled downwardly at an angle of about 6° form the outside edge to the clamping mouth 18 in the closed position thereof.

Figure 1:
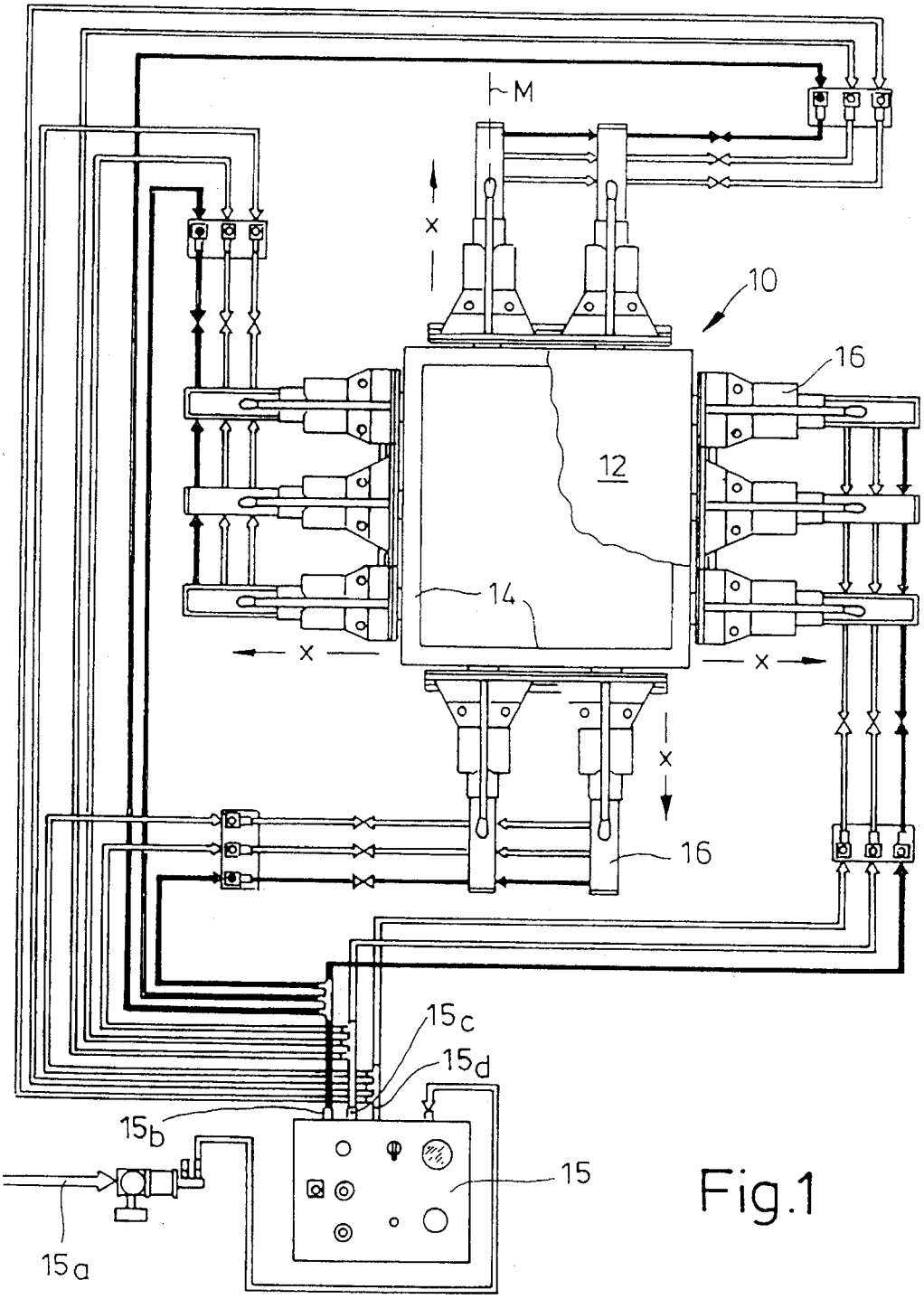
FIG. 1 is a plan view of an apparatus for stretching screen material for the screen printing process with four groups of stretching devices.

In FIG. 1 reference numeral 15 indicates a control unit which is supplied from the circuit $\mathbf{15}_a$ with compressed air at a maximum of bars and from which three control conduit $\mathbf{15}_b$ through $\mathbf{15}_d$ extend.

Figure 12:
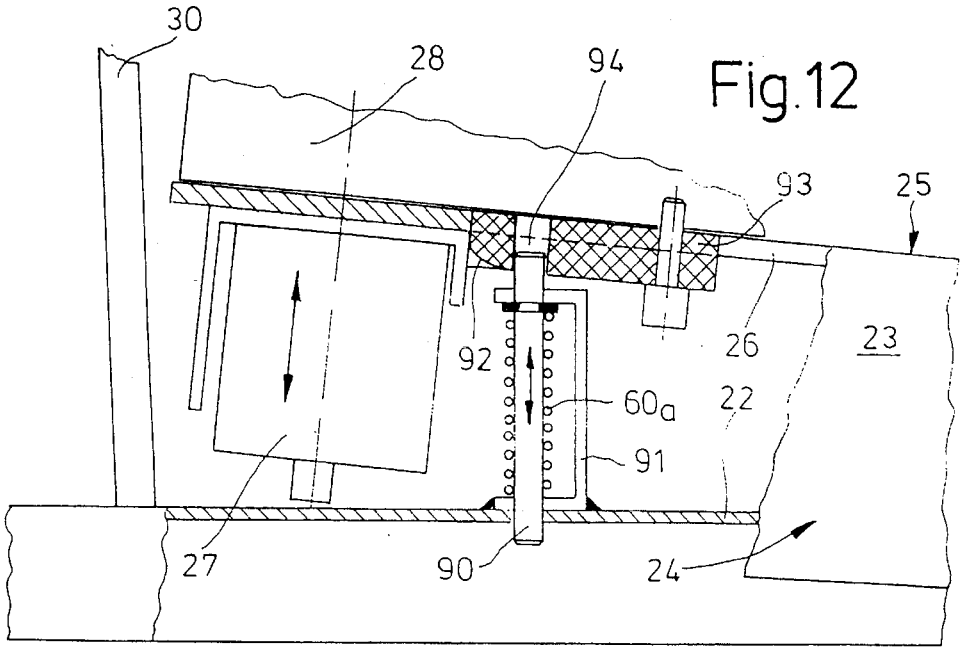
FIG. 12 is a sectional view on an enlarged scale of a detail from FIG. 1.

The stretching device 16 has on a base rail 22 a channel-like wedge profile member 24 which opens downwardly towards same and which has a sliding surfaces 25 which is inclined at an angle w and over which a slider or carriage 28 is displaceably supported, above a central longitudinal slot 26 of a length a in the wedge profile member 24. Projecting up at the end of the wedge profile member 24 is an abutment tongue 30; as shown in FIG. 3, the frame 14 extends between the abutment tongue 30 and a holding loop member 31 which is displaceable and which can also be fixed in latching engagement by a transverse pin 31*a*. Disposed on the channel-like wedge profile 24, on the side of the abutment tongue 30 which is remote from the frame 14, is a short-stroke cylinder 27 which is supported on the base rail 22 and which is described in greater detail with reference to FIG. 12.

Cast on the slider or carriage 28, transversely to the longitudinal axis M of the stretching device 16, is a lower clamping jaw 32 which projects at both sides and which is in the configuration of a channel member and in whose upwardly opening channel space is held a strip 34 of elastic material. Disposed opposite the strip 34, in an upper clamping jaw 36, are two parallel round profile members 37 which are also elastic.

Figure 4:
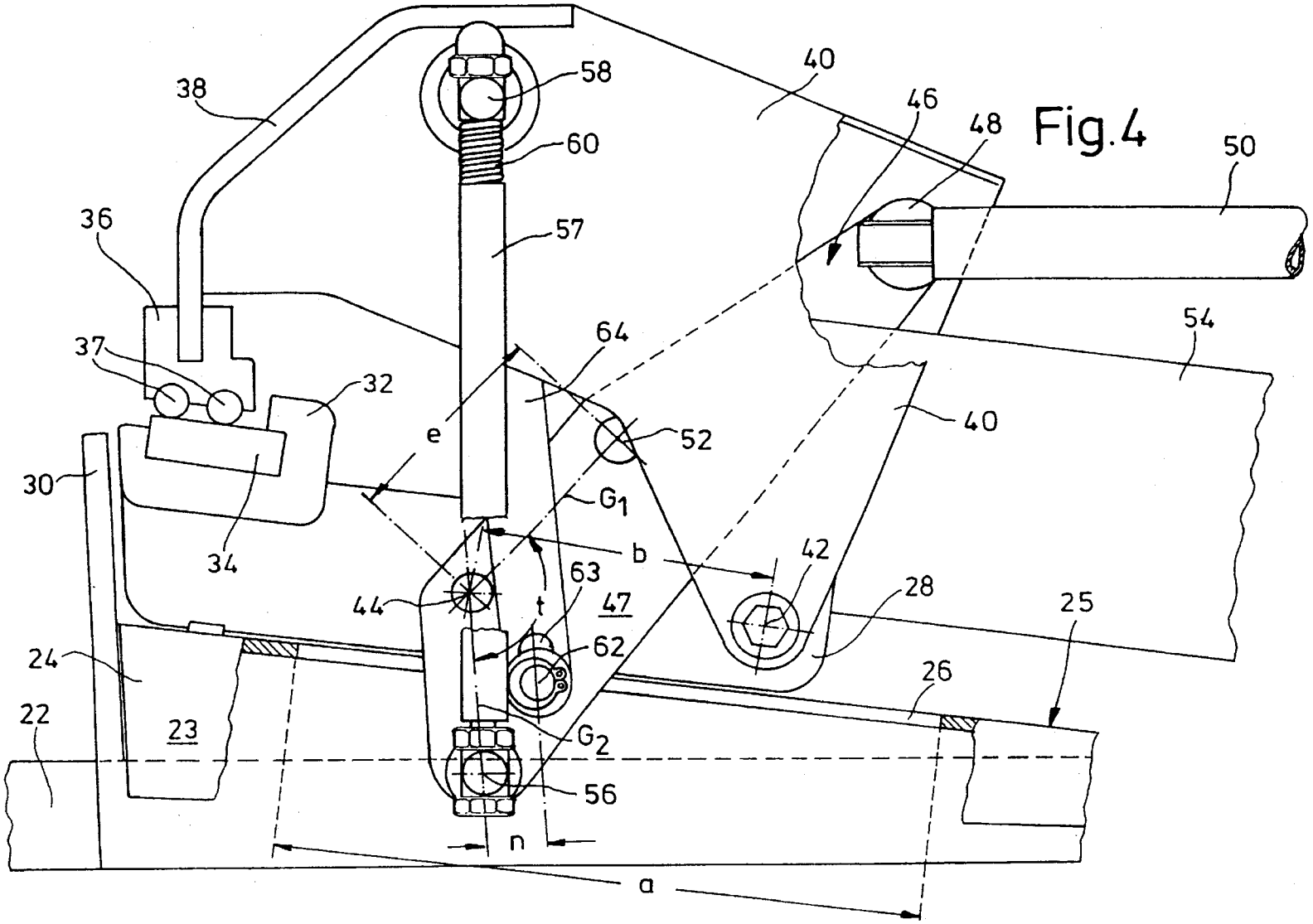
FIG. 4 is a side view on a larger scale than FIG. 3 of a closed clamping mouth of the stretching device.

FIG. 4 in particular makes it clear that the upper clamping jaw 36 is a shaped bar member which is fixed to a downwardly facing pressing edge of a skirt or apron 38 which is angled three times in respect of its cross-section; the skirt 38 is fixedly connected to a hood-like pivotable body 40 of U-like cross-section which opens downwardly and through which extends a pivot axis 42 of the slider or carriage 28.

Provided on the slider or carriage 28 parallel to the pivot axis 42 and at a spacing b of about 65 mm in relation thereto is a rotary axis 44 for a loop-shaped member 46 which is movable within the pivotable body 40 and whose two legs 47, through which the rotary axis passes, are movable parallel to the side surfaces 23 of the wedge profile member 24. Projecting from the upper yoke web portion 48 which connects the limbs 47 of the loop-shaped member is a hand or closing lever 50 which can be displaced in a central longitudinal opening 39 in the skirt or apron 38 between the open position of the clamping jaws 32, 36 and the closed position thereof.

Figure 5:
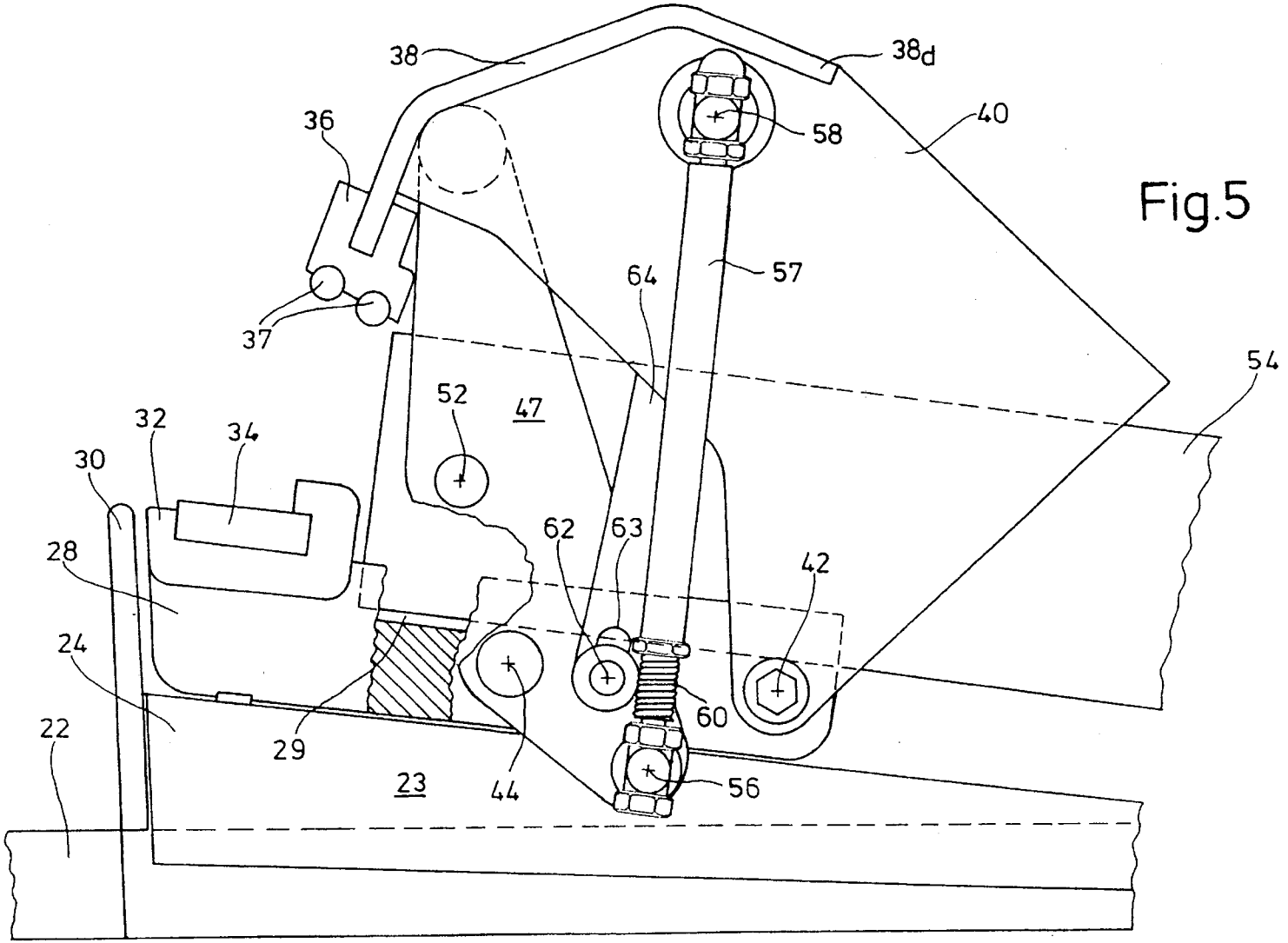
FIG. 5 shows the clamping mouth of FIG. 4 in the open position.

At a spacing e of 40 mm in this case, a tubular connecting portion 54 is pivotably connected to the limbs 47 of the loop-like member by a pair of aligned pivot pins 52. The tubular connecting portion 54 can be moved in a longitudinal trough 29 in the slider or carriage 28 (FIGS. 5 and 6).

As shown in FIG. 4, a straight line G2 passes through the rotary axis 44 and a further pivot point 56, at an angle t of about 135° relative to the straight line G1 connecting the rotary axis 44 and the pivot pin 52. Mounted on the limb 47 at the pivot point 56, at approximately the same spacing e relative to the rotary axis 44, is a two-part control bar 57 which at the other end is connected to the pivotable body 40 at the outside thereof by a pivot pin 58. Reference numeral 60 denotes a coil spring around an axial telescopic part of the control bar 57 which is variable in respect of length; the coil spring 60 can be provided at the base of the control bar 57 (FIGS. 1 and 5) or adjacent the upper end thereof (FIGS. 4 and 6).

Disposed approximately contrally between the rotary axis 44 and the pivot point 56—and laterally displaced by a distance n of about 18 mm—on the limb 47 of the loop-shaped member 46 there is also a pivot pin 62 which engages into a slot 63 in a rocker member 64 which is movable within the pivotable body 40.

Figure 6:
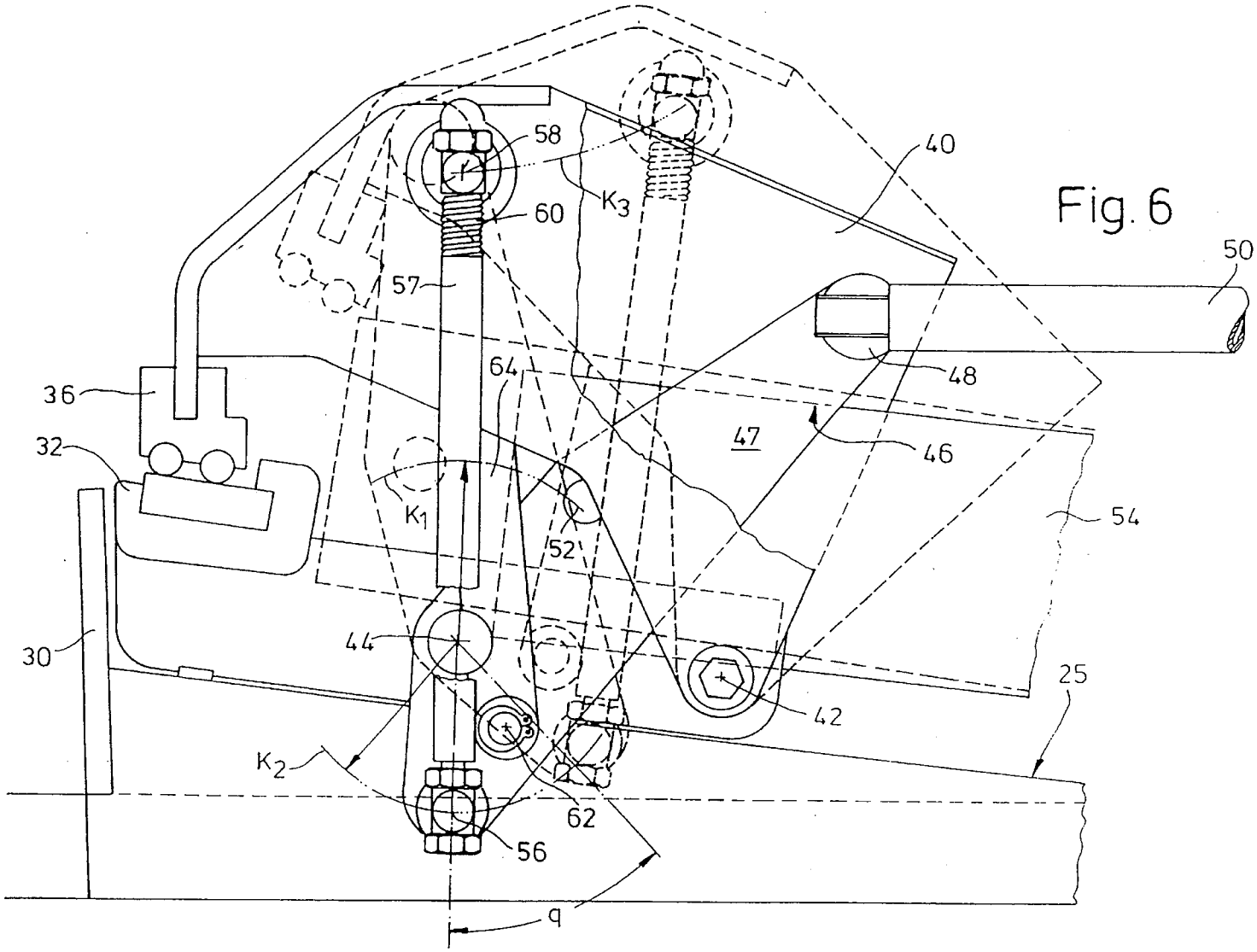
FIG. 6 shows the clamping mouth of FIGS. 4 and 5 in two different positions.
Figure 7:
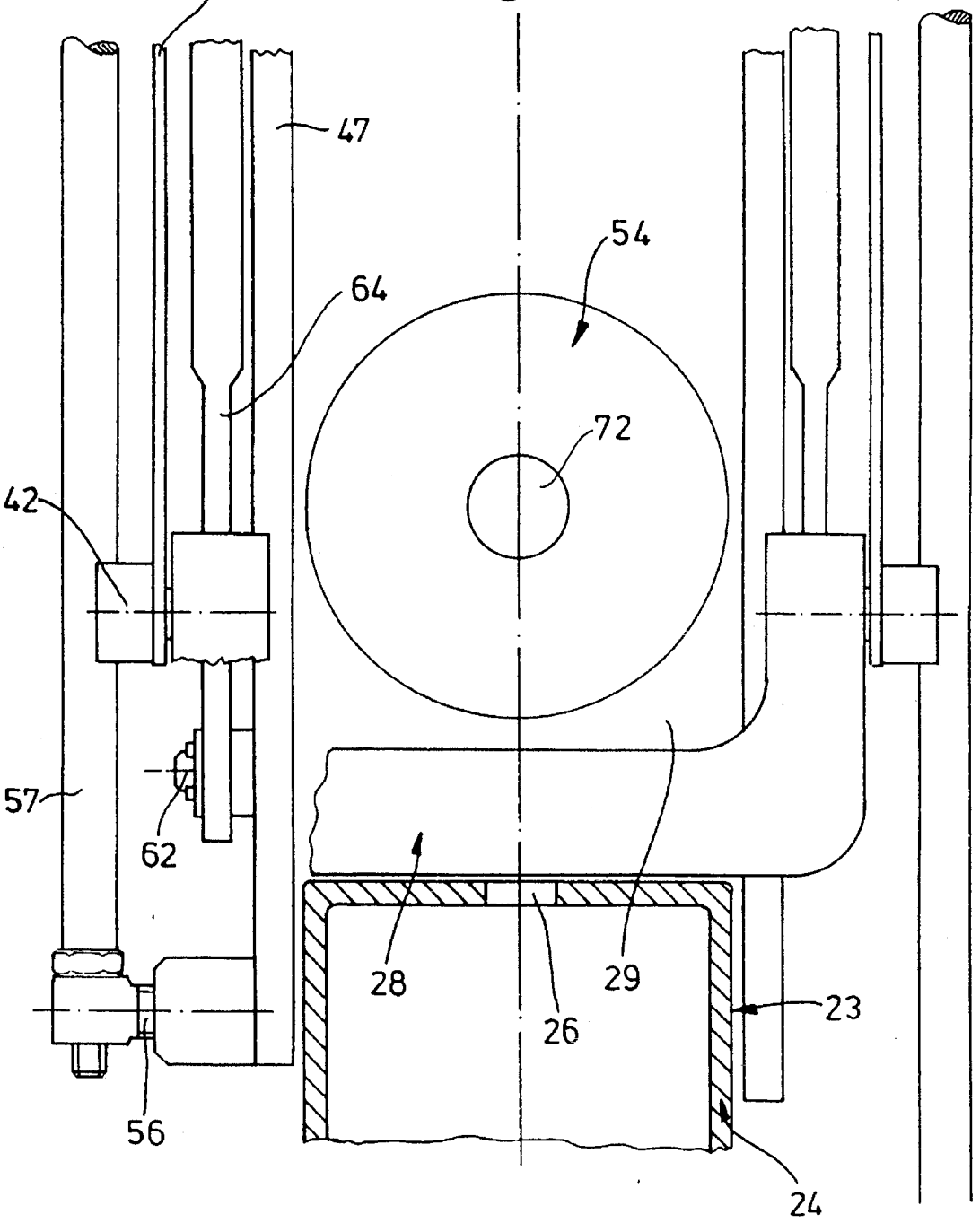
FIG. 7 is a partly sectional front view of parts of FIGS. 4 and 5.
Figure 9:
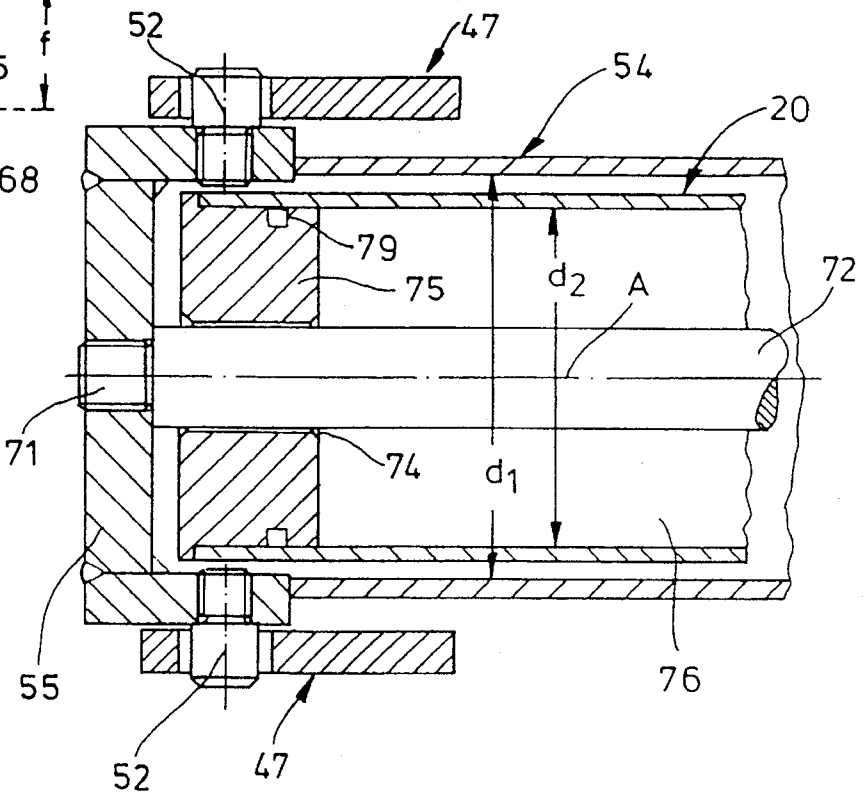
FIG. 9 is a view in section through a part of a cylinder of the stretching device.

FIG. 6 shows the travel movement of the individual components 40, 46, 57, 64 out of the open position of the clamping jaws 32, 36 as indicated in broken line, into the closed position, about the pivot axis 42 and the rotary axis 44. As it moves the pivot pin 52 generates a circular contour K1 about the rotary axis 44 while the pivot point 56 generates a circular contour K2. Those movements K1 and K2 result in a circular contour K3 as the path of movement of the pivot pin 58.

Figure 8:
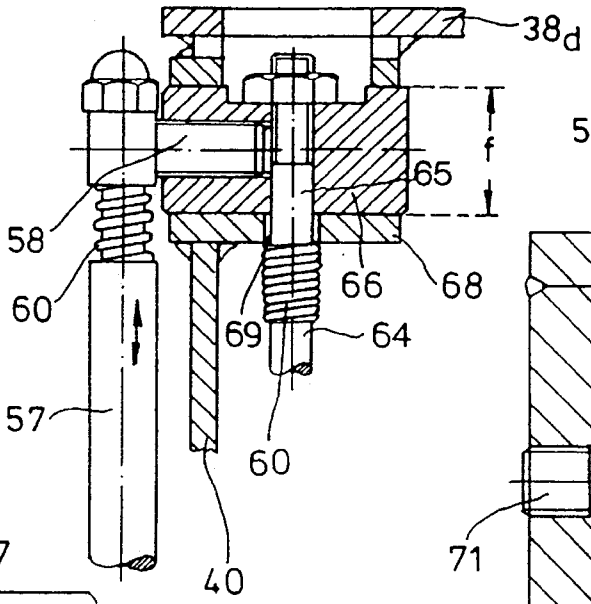
FIG. 8 is a view in section through a pivot location of the stretching device.
Figure 10:
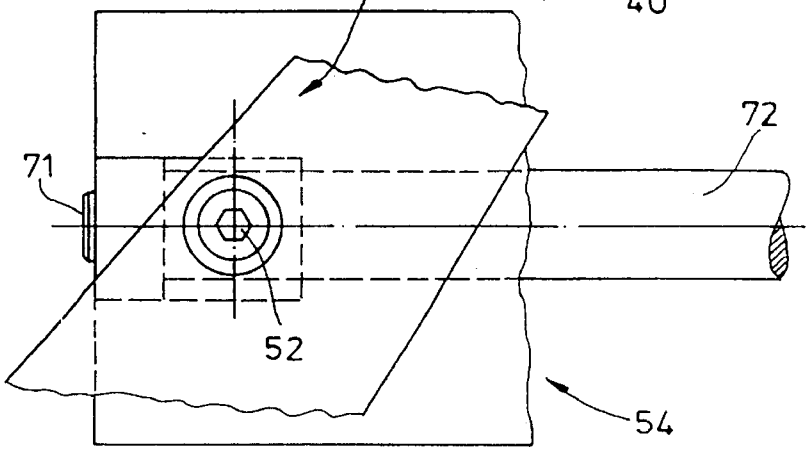
FIG. 10 is a partial side view of a detail from FIG. 4.

As shown in FIG. 8, the upper end of the rocker member 64 is in the form of a round end pin 65 which is embraced by a coil spring 60, and is rotatably attached to the pivot pin 58 of the control bar 57. The pivot pin 58 is carried in a mounting pin member 66 of a diameter f of about 16 mm which in turn is enclosed by a sleeve 68 welded at the inside to the roof part 38*d* of the skirt or apron 38. At the downwardly directed part of its periphery the sleeve 68 has a guide slot 69 for the end pin 65. In an embodiment which is not shown, a pin-like portion provided on the mounting pin member 66 passes through a mounting eye in the head of the control bar 57 whereby the mounting eye is connected to the mounting location.

The tubular connecting portion 54 which is closed at its end by a plate 55 and which, as stated, is attached to the loop-shaped member 46 by pivot pins 52 accommodates the head end of the above-mentioned pulling cylinder 20. In another embodiment, instead of the end plate 55, the arrangement has a diametral yoke bar or rod.

The screwthreaded end 71 of a piston rod 72 is screwed into the end plate 55 of the tubular connecting portion 54 of a diameter d1 which here is 58 mm. The piston rod 72 projects, on the longitudinal axis A of the tubular connecting portion 54, through the central bore 74 in an end wall 75 of the cylinder 20 into the interior 76 thereof—of a diameter d2 of 50 mm—and is connected by its other end to a piston disk 78 which is axially displaceable therein. Reference numeral 79 denotes sealing O-rings.

The tubular wall 80 of the cylinder 20 is carried with its end remote from its end wall 75 in sealed relationship on an end plug member 82 which at 84 is pivotably connected to a rear flange 86 which projects up from the base rail 22.

Figure 11:
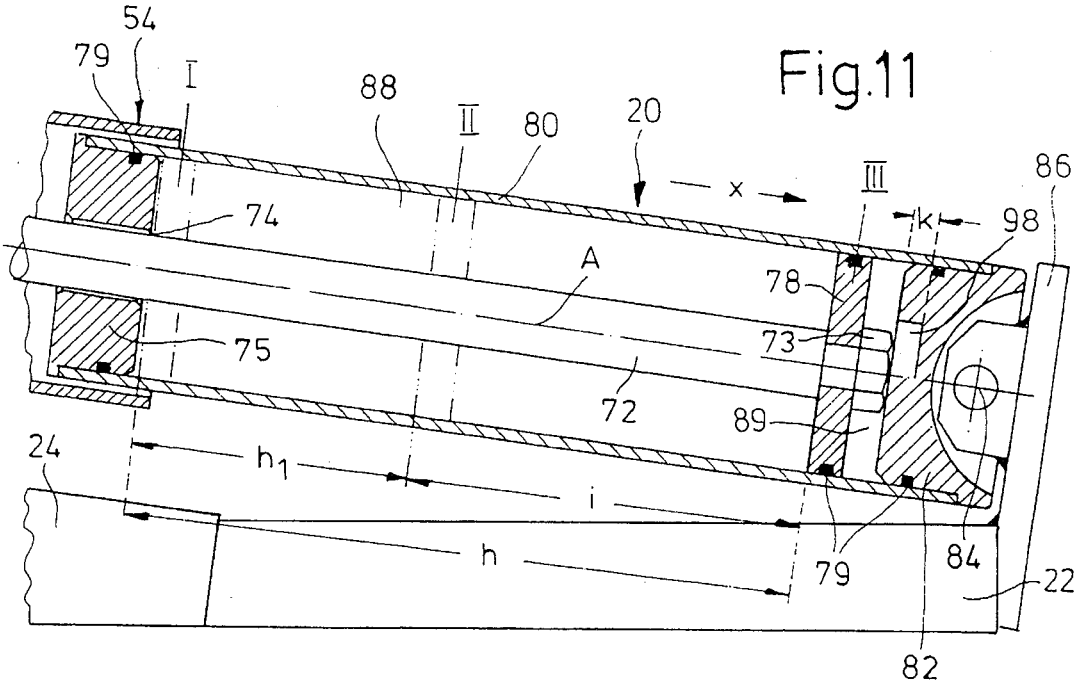
FIG. 11 is a view in longitudinal section on a smaller scale than FIG. 10 through the entire cylinder with a piston disk in different positions.

If the clamping mouth 18 is open as shown in FIG. 5, the piston disk 78 is in the open position indicated at I in FIG. 11, adjacent the end wall 75, and at the spacing of the stroke travel h from its end position III which is shown at the right in FIG. 11. In the illustrated embodiment the stroke travel h of the piston disk 78 is about 150 mm. The angle q described by the pivot point 56 when the piston disk 78 is transferred from the central position II into the above-described open position I is about 56° (see FIG. 6).

Opening of the clamping mouth 18 can be effected by manual actuation of the closing or hand lever 50, but it is usually produced pneumatically by flow medium passing into the cylinder 20 and acting on the piston disk 78. The piston disk 78 is moved from any position of the stroke travel h through the central position 11 into the open position I.

In that procedure the slider or carriage 28 is also moved into and fixed in the forward position, in which case a retaining pin 90 which is guided in a U-shaped member 91 is pushed by a spring $60_a$ along an inclined surface 92 of a slide block 93 into the retaining opening 94 provided for that purpose.

As the block 93—preferably made from plastic material—is fixed to the underside of the slider or carriage 28, the latter is held in the described engagement position until the retaining pin 90 is disengaged from the retaining opening 94. A movable latch or pawl (not shown here) can also serve as the retaining member.

When the web 12 is fitted into the opened clamping mouth 18 the upper edge of the strip 34 of elastic material lies about 2 to 3 mm beneath the surface 13 of the advanced printing frame 14. After insertion of the web 12 the clamping jaws 32, 36 of the clamping mouth 18 are brought together with the closing or hand lever 50 and prestressed until the position diagrammatically shown in FIG. 4 is reached. The pivot pins 62 of the pair of the rocker member 64 bear against the bottom of the respective slots and are disposed behind the associated control bar 57 by the specified distance n of lateral displacement.

The above-described prestressing operation can also take place pneumatically by the piston disk 78 being acted upon by flow agent by way of the upstream chamber or the pressure chamber 88, and being moved from the open position I shown in FIG. 11 into the central position II over a partial stroke length hl of about 50 mm.

Prior to the actual stretching operation the short-stroke cylinder 27 which is fixed to the wedge profile member 24 is controlled by way of a conduit 97 indicated in FIG. 3 in such a way that the block 93 is lifted out of the retaining position and releases the slider or carriage 28 so that it can be moved in the pulling direction x.

The clamping mouth 18 also lifts by the stroke movement of the short-stroke cylinder 27 and holds the web 12 for the stretching operation about 8 to 10 mm above the surface 13 of the frame 14. That spacing relative to the frame 14 serves in particular to avoid damaging the web 12 in the stretching operation.

For the stretching operation the chamber 88 which is defined by the end wall 75 and the piston disk 78 is acted upon with pneumatic flow agent by way of a conduit which is only indicated at 95 in FIG. 3 and thereby produces a controllable pneumatic closing force at the clamping mouth 18, which is additional to the mechanical closing force.

The distance 1 in FIG. 11, which remains in relation to the partial stroke length hl to afford the full stroke length h, determines the possible stretching travel of the stretching device 16, but usually the full stroke length h is not used at all.

After the stretching operation the clamping mouth 18 is lowered into the position described with reference to FIG. 3 so that the web 12 lies for glueing on the frame 14.

FIG. 11 only indicates, above the longitudinal axis A at 98, a recess which is formed in the rear stopper member 82 at the inside surface thereof, in a further embodiment. With that arrangement, the piston rod nut 73 which holds the piston disk 78 extends into the recess 98 in the limit position III, whereby the stroke length is increased by the depth dimension k of the recess 98.

The introduction of flow agent into a rear chamber 89 which is provided between the piston disk 78 and the end stopper member 82 and which is of variable volume by way of a further conduit 96 (see FIG. 3) can provide that the piston disk 78 is urged in opposite relationship to the pulling direction x, in order to open the clamping mouth 18, in addition to the mechanical return effect.

We claim:

1. Apparatus for stretching out a cloth portion on a printing frame, said apparatus comprising stretching devices arranged at sides of the frame and in which the cloth portion is fixed by respective clamping mouths for engaging the cloth portion with each said clamping mouth comprising clamping jaws which are movable relative to each other and which are applied against each other on the closing travel of a closing lever under a pressing pressure, and the cloth portion being tensioned by a change in position of the clamping mouth units in a pulling direction caused by associated piston/cylinder units, said apparatus further characterised in that when the clamping jaws for a respective clamping mouth are brought together, the closing travel which is determined by the closing lever is followed by a further closing travel under control of a piston rod positioned within a cylinder and forming with said cylinder an associated piston/cylinder unit, said piston rod having an open position (I) in respect of the clamping mouth, which open position is near the clamping jaws, a central position (II) with closed clamping jaws after a partial stroke length ($h_1$), and a stroke path (stroke length i) adjoining said partial stroke length for the stretching operation.

2. Apparatus according to claim 1 further comprising a short-stroke cylinder by which a respective clamping mouth is disposed, prior to insertion of the cloth portion, beneath a surface of the printing frame and closed after the insertion operation, the short-stroke cylinder being actuable for unlocking a slider and for setting the respective clamping mouth above the surface of the printing frame.

3. Apparatus according to claim 2 characterised in that a profile member guides the slider and is adapted to be raised by the short-stroke cylinder which is mounted adjacent the printing frame beneath the profile member, and further characterised in that a retaining member is associated with the short-stroke cylinder, the retaining member engaging into the slider to hold the slider in a limit position thereof.

4. Apparatus according to claim 1 further comprising a piston disk on the piston rod which forms part of the piston/cylinder unit for the pulling movement of a respective stretching device.

5. Apparatus according to claim 4 further comprising each said clamping mouth being held in a gripping position until disengagement of a retaining member for a short-stroke cylinder associated with said clamping mouth, wherein the piston disk is moved into the central position (II) over the partial stroke length ($h_1$).

6. Apparatus according to claim 5 further comprising each said clamping mouth including a rail-like base element and a pivot mounting projecting up from said rail-like base element for the cylinder, the cylinder being supported displaceably in a tubular connecting portion to which the piston rod is fixed by an end remote from the piston disk, and the piston rod passing through an end wall of the cylinder and being supported movably in a sealed through bore.

7. Apparatus according to claim 6 further comprising the tubular connecting portion being pivotally connected to a guide element, and said guide element being pivotably connected to a slider which carries the clamping jaws and which is supported displaceably in the pulling direction (x) on a profile member which forms part of said base element.

8. Apparatus according to claim 7 wherein said guide element is in the form of a loop-shaped member having limbs which engage over two sides of said profile member and are connected to the slider by a rotary axis, the loop-shaped member being arranged within a hood-like support member serving as a pivotable body, and being connected at each side to said pivotable body by two pivot bars which are pivotally connected to the loop-shaped member at a spacing (n) relative to each other.

9. Apparatus according to claim 8 wherein the slider has a pivot axis for the hood-like support member parallel to a rotary axis for the loop-shaped member.

10. Apparatus according to claim 9 wherein a pivot pin is connected as a pivot between a first one of the pivot bars and the pivotable body and a second one of the pivot bars comprises a rocker member, said rocker member having an end which provides a slot for a pivot axis of the loop-shaped member.

11. Apparatus according to claim 10 characterised in that the pivot axis is arranged to be guided by one of the limbs of the loop-shaped member about a pivot point for the first one of the pivot bars which is formed by a control bar.

12. Apparatus according to claim 9 characterised in that the pivotable body with parallel side walls flanking the tubular connecting portion adjoins the pivot axis of the slider and holds one of the clamping jaws with a front edge which is parallel to the pivot axis, and that disposed opposite a pivot location for the tubular connecting portion on the other side of the rotary axis on the limb of the loop-shaped member is a pivot point for a control bar which is pivotally connected to the pivotable body.

* * * * *